US010328743B2

(12) United States Patent
Marshall et al.

(10) Patent No.: US 10,328,743 B2
(45) Date of Patent: Jun. 25, 2019

(54) WRITING INSTRUMENT ATTACHMENT

(71) Applicant: UFAB MOMS, LLC, Peachtree City, GA (US)

(72) Inventors: Annette M. Marshall, Fayetteville, GA (US); Mellissa Dianne Craig, Fayetteville, GA (US)

(73) Assignee: UFAB MOMS, LLC, Peachtree City, GA (US)

( * ) Notice: Subject to any disclaimer, the term of this patent is extended or adjusted under 35 U.S.C. 154(b) by 114 days.

(21) Appl. No.: 15/787,277

(22) Filed: Oct. 18, 2017

(65) Prior Publication Data

US 2018/0037050 A1 Feb. 8, 2018

Related U.S. Application Data

(60) Provisional application No. 62/552,879, filed on Aug. 31, 2017.

(51) Int. Cl.
*B43K 23/008* (2006.01)
*B43K 29/00* (2006.01)
*B43K 29/08* (2006.01)

(52) U.S. Cl.
CPC ..... *B43K 23/008* (2013.01); *B43K 29/004* (2013.01); *B43K 29/08* (2013.01)

(58) Field of Classification Search
CPC ..... B43K 23/008; B43K 29/00–20; A63F 9/08–088; A63F 2009/1292; A63F 2009/12928; A44C 5/0046; G09F 2023/0016
See application file for complete search history.

(56) References Cited

U.S. PATENT DOCUMENTS 940,797 A * 11/1909 Fraser ..... B43K 19/02 15/184
3,109,251 A * 11/1963 Krueger ..... B60Q 9/00 40/503
3,338,215 A * 8/1967 Chin ..... B43K 21/003 401/82
4,983,062 A * 1/1991 Hour ..... A63F 9/001 273/153 S
5,044,804 A * 9/1991 Chuang ..... B43K 5/005 401/34

(Continued)

FOREIGN PATENT DOCUMENTS

CA 2327976 * 6/2002
GB 2541670 * 1/2017

*Primary Examiner* — David J Walczak
*Assistant Examiner* — Randall A Gruby
(74) *Attorney, Agent, or Firm* — BakerHostetler

(57) ABSTRACT

A writing instrument attachment includes first and second band portions and a coupling mechanism. The first band portion include a first inner surface defining a passageway along a longitudinal axis and a first outer surface having a first outer radius that encompasses the first inner surface. The second band portion is integrally affixed to an end of the first band portion. The second band portion includes a second inner surface defining a chamber along the longitudinal axis having an inner radius that is greater than the first outer radius. The coupling mechanism includes a groove located at a first position on the second inner surface and a tab located at a second position on the outer surface. The first position and the second position are collinear.

11 Claims, 4 Drawing Sheets

(56) References Cited

U.S. PATENT DOCUMENTS 5,584,195 A * 12/1996 Liu ..... A44C 5/0007 401/131
D425,118 S * 5/2000 Platts ..... D19/201
6,149,330 A * 11/2000 Chuang ..... B43K 7/005 401/34
D434,798 S * 12/2000 Platts ..... D19/136
6,296,409 B1 * 10/2001 Cherry ..... B43K 23/004 16/430
D465,807 S * 11/2002 Murton ..... D19/148
D475,085 S * 5/2003 Whitehorn ..... D19/118
6,612,766 B2 * 9/2003 Collins ..... B43K 7/005 401/195
6,688,792 B1 * 2/2004 Reichmann ..... B43K 27/08 401/18
6,739,780 B1 * 5/2004 Kuo ..... B43K 5/005 401/195
D502,215 S * 2/2005 Hung ..... D19/118
6,966,717 B1 * 11/2005 Kuo ..... B43K 5/005 401/195
7,014,379 B2 * 3/2006 Cheng ..... B43K 23/004 16/430
7,136,052 B1 * 11/2006 Lam ..... G06F 3/03545 345/179
7,275,744 B1 * 10/2007 Kuo ..... A63F 9/001 273/153 S
D591,145 S * 4/2009 Kosunen ..... D8/396
7,774,963 B2 * 8/2010 Puglisi ..... G09F 23/00 40/334
9,789,727 B1 * 10/2017 Phillips ..... B43K 23/008
D812,139 S * 3/2018 Feng ..... D19/192
10,131,179 B2 * 11/2018 Mess ..... B43K 8/003
2004/0057772 A1 * 3/2004 Pearce ..... A46B 5/026 401/6
2005/0053414 A1 * 3/2005 Collins ..... B43K 7/005 401/195
2007/0048061 A1 * 3/2007 Travers ..... B43K 23/001 401/6
2007/0059089 A1 * 3/2007 Junkins ..... B43K 5/005 401/195
2008/0219746 A1 * 9/2008 Lee ..... B43K 1/00 401/6
2012/0318707 A1 * 12/2012 Zivitz ..... B43K 23/008 206/575
2014/0093300 A1 * 4/2014 Schwartzberg ..... B43K 29/00 401/195
2014/0130298 A1 * 5/2014 Vassel ..... B43K 23/00 15/443
2016/0229219 A1 * 8/2016 Pincus ..... B43K 23/008
2017/0106692 A1 * 4/2017 Imbesi ..... B43K 23/001
2018/0178581 A1 * 6/2018 Feng ..... B43K 8/003

* cited by examiner

WRITING INSTRUMENT ATTACHMENT

CROSS-REFERENCE TO RELATED APPLICATIONS

This application claims priority to and the benefit of U.S. Provisional No. 62/552,879, filed Aug. 31, 2017, the contents of which are hereby incorporated in their entirety.

TECHNICAL FIELD

The present disclosure is directed to attachments for writing instruments and, more particularly, to interlocking tubular bodies adapted to interconnect with one another and to fit on the body of a writing instrument.

BACKGROUND

One person's writing instruments, such as pens, mechanical pencils, markers, and wooden pencils, are often indistinguishable from another's. This may be particularly true for students, who may each use pencils from the same package. There is a need for one to be able to distinguish their writing instrument from another's.

SUMMARY

The disclosed apparatuses allow a user to mark or design their writing instrument by selecting one or more interlocking tubular bodies and sliding these tubular bodies onto the body of the writing instrument. The interlocking tubular bodies may optionally be comprised of a gripping or cushioning material, such as rubber, plastic, or other resilient material, so that the interlocking tubular bodies may also function as a pencil grip.

According to one aspect, a writing instrument attachment may have a body designed to fit over the body of a pencil to form a decoration or identifier on that pencil. Optionally, that body may also serve as a pencil grip. The body may be substantially tubular, like a bead or sleeve. Optionally, the body may have one or more decorative aspects, including a three-dimensional shape, such as a letter or a symbol. The body may be designed to interlock with the body of another writing instrument attachment, so that two writing instrument attachments can cooperate to decorate the same writing attachment. To accomplish this, each writing instrument attachment may have two complementary ends, so that the "male" component of one writing instrument attachment may interlock with the "female" component of another writing instrument attachment. For example, a first end of the writing attachment may be slightly smaller in radius than the second end. The first end may include one or more tabs that are arranged and sized to slide into complementary grooves on the second end, as the first end is inserted into and held in place by the second end of the other writing attachment.

In an aspect, this disclosure is directed to a writing instrument. The writing instrument may include a cylindrical body having a longitudinal axis. The writing instrument may include a removable attachment having a longitudinal passageway that receives and surrounds a portion of the cylindrical body. The removable attachment may include a first band portion and a second band portion. The first band portion may include a first inner surface defining the longitudinal passageway along the longitudinal axis and a first outer surface that encompasses the first inner surface. The first outer surface may have a first outer radius. The second band portion may be integrally affixed to a first end of the first band portion. The second band portion may include a second inner surface defining a chamber along the longitudinal axis. The chamber may have an inner radius that is greater than or equal to the first outer radius. The removable attachment may include a coupling mechanism to couple the removable attachment to a second removable attachment. The coupling mechanism may include at least one groove located at a first position on the second inner surface and at least one tab located at a second position on the outer surface.

In an aspect, this disclosure is related to a pencil grip comprising a first tubular body and a second tubular body. The first tubular body may include a first top band and a first bottom band. The first top band may include a first top band inner surface defining a passageway along a longitudinal axis. The first top band may also include a first top band outer surface that encompasses to the first top band inner surface, the first top band outer surface having a first top band outer radius. The first top band may also include a first tab located on the first top band outer surface. The first bottom band may be distal from and integrally affixed to the first top band. The first bottom band may include a first bottom band inner surface defining a first chamber along the longitudinal axis. The first chamber may having a chamber radius that is greater than the first top band outer radius. The first bottom band may include a first groove located on the first bottom band inner surface. The second tubular body may be removably engaged with the first chamber of the first tubular body. The second tubular body may include a second top band and a second bottom band. The second top band may include a second top band inner surface defining a chamber along the longitudinal axis. The second top band outer surface may encompass the second top band inner surface. The second top band outer surface may have a second top band outer radius that is greater than or equal to the first top band outer radius. The second top band may include a second tab located on the second top band outer surface. The second bottom band may be distal from and integrally affixed to the second top band. The second bottom band may include a second bottom band inner surface defining a second chamber aligned with the longitudinal axis. The second bottom band may include a second groove located on the first bottom band inner surface. The second groove may be removably engaged with the first tab and cooperating with the first tab to prevent relative rotation of the first tubular body and the second tubular body with respect to the longitudinal axis.

In another aspect, this disclosure is directed to an apparatus. The apparatus may include a first band portion and a second band portion. The first band portion may include a first inner surface defining a passageway along a longitudinal axis and a first outer surface that encompasses the first inner surface. The first outer surface may have a first outer radius. The second band portion may be integrally affixed to a first end of the first band portion. The second band portion may include a second inner surface defining a chamber along the longitudinal axis. The chamber may have an inner radius that is greater than the first outer radius. The apparatus may include a coupling mechanism. The coupling mechanism may include at least one groove located at a first position on the second inner surface and at least one tab located at a second position on the outer surface. The first position and the second position may be collinear.

DETAILED DESCRIPTION

Figure 1:
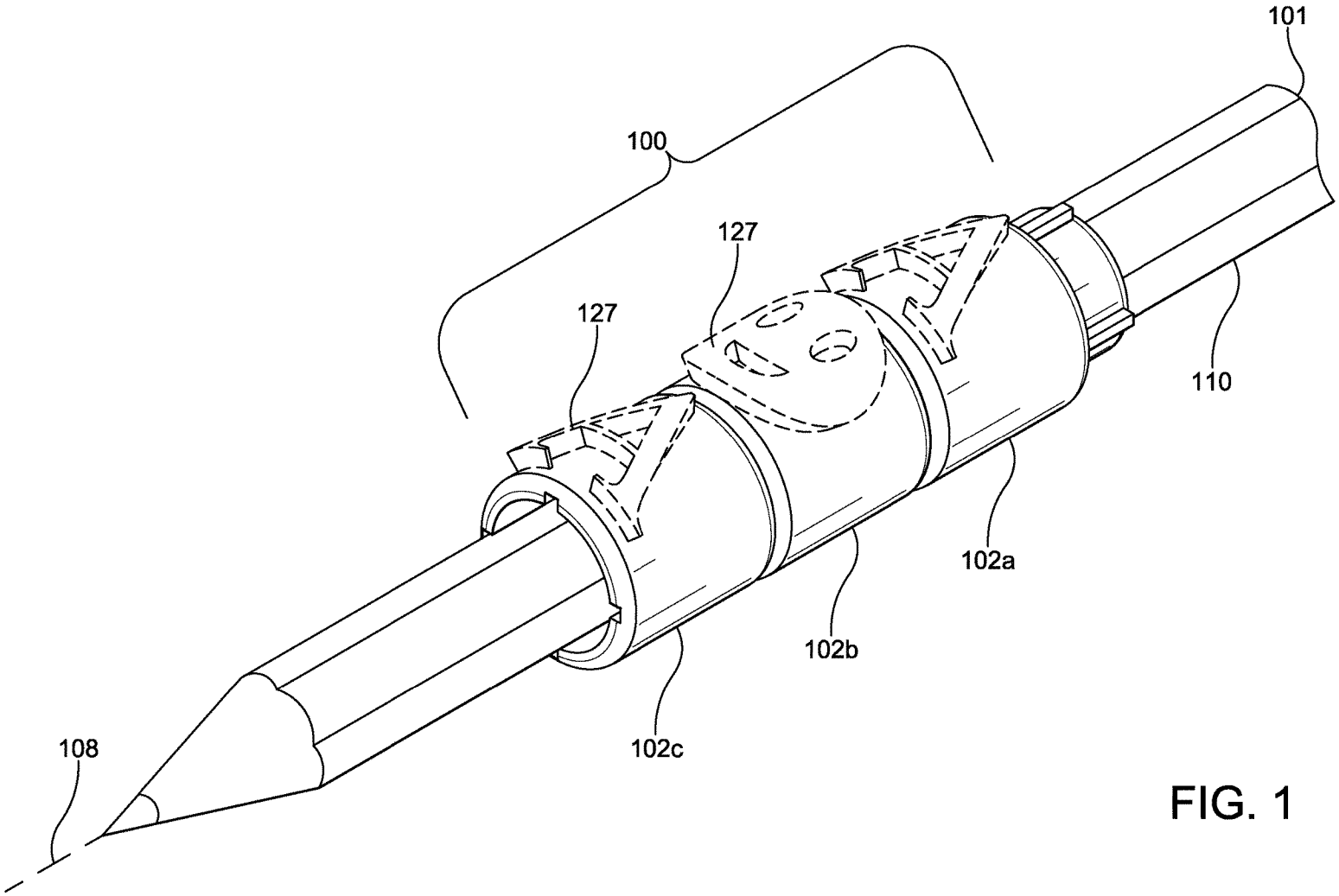
FIG. 1 is an illustration of a pencil grip including three tubular bodies.

FIG. 1 illustrates an exemplary pencil grip 100. Pencil grip 100 may be made of one or more pieces that interconnect along a longitudinal axis of a writing instrument 101. Writing instrument 101 may be a traditional writing instrument, such as a pen, pencil, crayon, marker, brush, or the like. Optionally, writing instrument 101 may be an electronic writing instrument, such as a device that interacts with an electronic device to form lines on an electronic document, like a stylus. Unlike traditional pencil grips, exemplary pencil grip 100 may be formed of multiple pieces so that a design, purpose, or identification can be customized by using different combinations of the pieces. For example, a color, shape, material, or design, such as a letter, emoji, or other symbol may vary among the pieces, so that different combinations may be used to customize pencil grip 100, and, by extension, writing instrument 101, based on user preference.

Each piece of pencil grip 100 may be a tubular body 102. Pencil grip 100 may be comprised of one or more tubular bodies 102. For example, FIG. 1 illustrates pencil grip 100 comprised of a first tubular body 102*a*, second tubular body 102*b*, and third tubular body 102*c*. First tubular body 102*a* and second tubular body 102*b* may interconnect via complementary, interlocking components of a coupler that are located on each of first tubular body 102*a* and second tubular body 102*b*. Similarly, second tubular body 102*b* and third tubular body 102*c* may interconnect via complementary, interlocking components of a coupler that are located on each of second tubular body 102*b* and third tubular body 102*c*. This interconnection and the interlocking components of the coupler are discussed in more detail below.

Each tubular body 102 may be a single integrated component. For example, each tubular body 102 may be manufactured as single piece such as, for example, via injection molding, additive manufacturing, 3D printing, or the like. The method of manufacturing tubular bodies 102 is not limiting.

The material composition of each tubular body 102 may vary. For example, tubular body 102 may be comprised of polymer or rubber. Some tubular bodies 102 may be made of material that elastic or gripping to enable the tubular bodies 102 to hug or surround the body of writing instrument 101.

Figure 2:
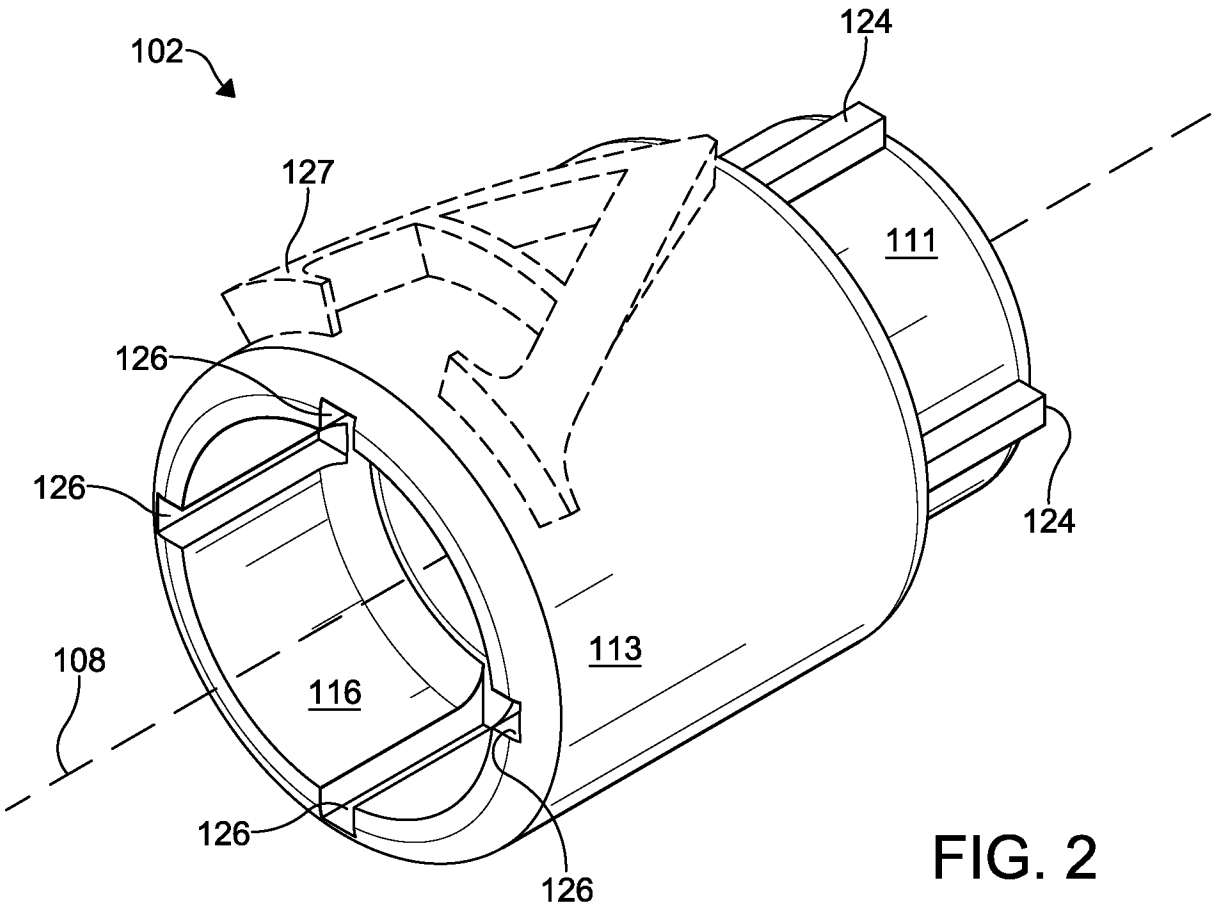
FIG. 2 is an illustration of an exemplary tubular body which may form all or part of a pencil grip.

FIG. 2 illustrates an exemplary tubular body 102. The shape of tubular body 102 may be understood as generally tubular or cylindrical, but tubular body 102 may have design variations may cause tubular body 102 to not be perfectly cylindrical. For example, tubular body 102 may have a hollow, tubular passageway, but this passageway may have a polygonal cross-section, such as a hexagonal cross-section, rather than a circular cross-section. Similarly, the cross-section of the outer surface of tubular body 102 is not limited to a circle. For example, the outer surface of tubular body 102 may include a raised character or pattern. This will become more apparent in light of the following description.

Tubular body 102 may be comprised of multiple bands. While these bands may be integrally connected to one another, for discussion purposes they are each described in turn, as one or more physical dimensions may vary among the bands.

Figure 3:
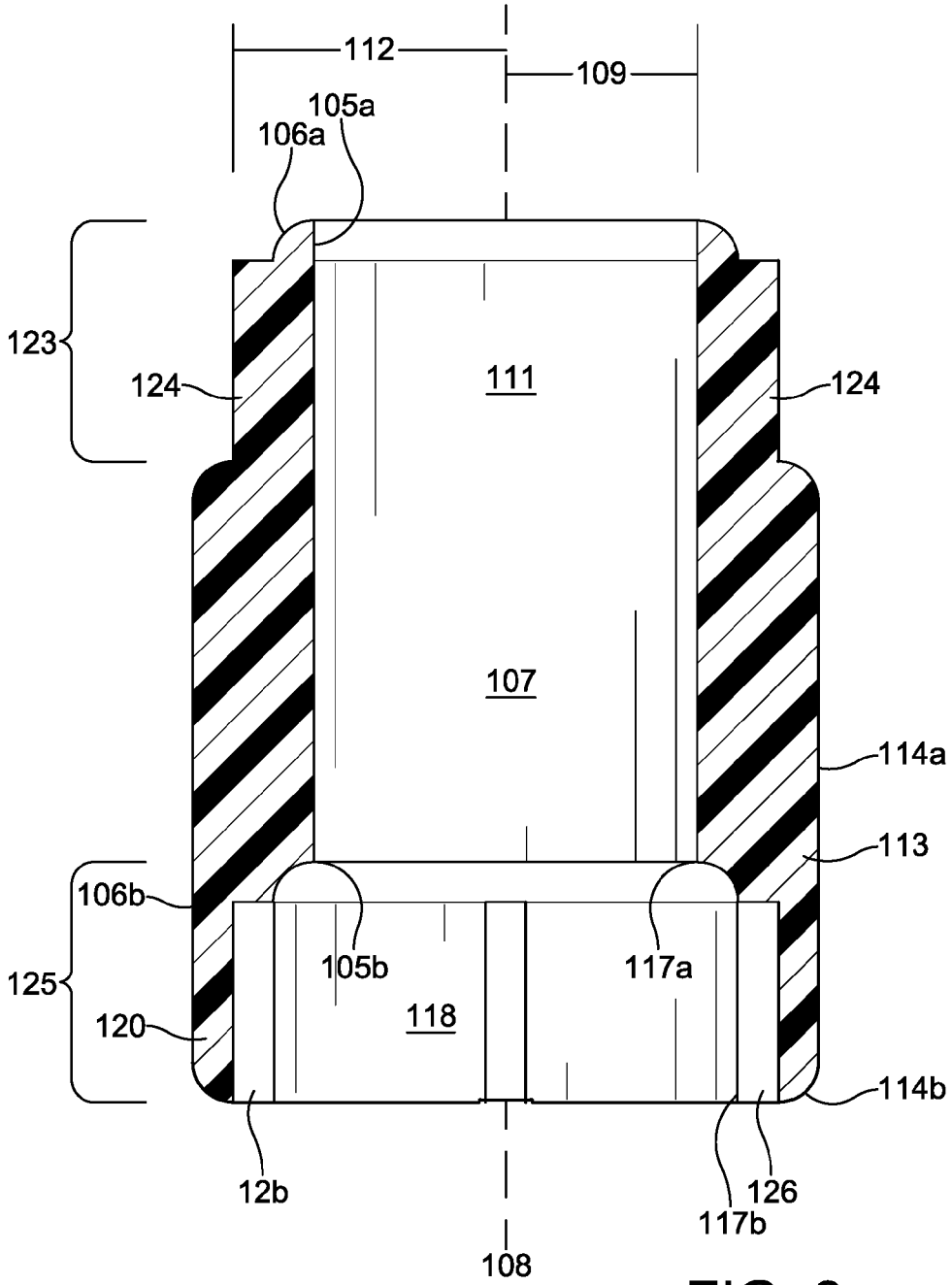
FIG. 3 is a cross-sectional view of an exemplary tubular body.

FIG. 3 illustrates a cross-section of tubular body 102. Tubular body 102 may include a top band 103. Top band 103 may have a first end 106*a* distal from a second end 106*b*. Top band 103 may have a top band inner surface 104 having a first opening 105*a* at first end 106*a* of top band 103 and a second opening 105*b* at second end 106*b* of top band 103. Top band inner surface 104 may define a passageway 107 along a longitudinal axis 108. Passageway 107 may be designed to receive a writing instrument 101, such that the longitudinal axis 108 is shared by both passageway 107 and writing instrument 101. As discussed above, top band inner surface 104 may be cylindrical or tubular, though the cross-section of top band inner surface 104 is not limited to a circle. A top band inner radius 109 of top band inner surface 104 may be based on the size of a pencil, pen, marker, crayon, brush, or other writing instrument 101. More specifically, top band inner radius 109 may be approximately the same as, or slightly larger than, the radius of the cross-section of writing instrument 101, such that passageway 107 is large enough to accommodate and receive a body 110 of writing instrument 101, but small enough so that body 110 of writing instrument 101 cannot move freely through passageway 107 without contacting top band inner surface 104. Top band inner radius 109 may preferably be small enough that tubular body 102 stays substantially stationary relative to body 110 of writing instrument 101 while writing instrument 101 is being used.

Top band 103 may also include a top band outer surface 111 that surrounds top band inner surface 104. Top band outer surface 111 and top band inner surface 104 may share longitudinal axis 108. For example, top band outer surface 111 may be concentric to top band inner surface 104. Like the cross-section of top band inner surface 104, a cross-section of top band outer surface 111 is not necessarily limited to a circle. Further, a shape of the cross-section of top band outer surface 111 is not necessarily the same as the shape of the cross-section of top band inner surface 104.

Tubular body 102 may include a bottom band 113 distal from and integrally affixed to top band 103. (While "top" and "bottom" designations are used for clarity, it is not necessary that tubular body 102 be oriented such that top band 103 is above bottom band 113; for example, tubular body 102 may be used so that bottom band 113 is above top band 103.) Bottom band 113 may be directly or indirectly affixed to top band 103. For example, a first end 114*a* of bottom band 113 may be integrally affixed to second end 106*b* of top band 103. Optionally top band 10 may be affixed to bottom band 113 via one or more intermediary bands.

Bottom band 113 may have a bottom band inner surface 116 having a first end 114*a* distal from a second end 114*b*. Bottom band 113 may include a first opening 117*a* at first end 114*a* of bottom band 113 and a second opening 117*b* at second end 114*b* of top band 103. Bottom band inner surface 116 may define a chamber 118 between first opening 117*a* of bottom band 113 and second opening 117*b* of bottom band 113, where first opening 117*a* is in communication with passageway 107, such that an aperture exists from first opening 105*a* of top band 103 through second opening 105*b* of top band 103, through first opening 117*a* of bottom band 113, and through second opening 117*b* of bottom band 113. Chamber 118 may have a different width than passageway 107. For example, chamber 118 and passageway 107 may be both be large enough to insert writing instrument 101, but chamber 118 may be wider than passageway 107.

Bottom band 113 may include a bottom band outer surface 120 that surrounds bottom band inner surface 116. Bottom band outer surface 120 and bottom band inner surface 116 may share longitudinal axis 108. For example, bottom band outer surface 120 and bottom band inner surface 116 may be concentric. Like the cross-section of bottom band inner surface 116, a cross-section of bottom band outer surface 120 is not necessarily limited to a circle. Further, a shape of the cross-section of bottom band outer surface 120 is not necessarily the same as the shape of the cross-section of bottom band inner surface 116.

Figure 4:
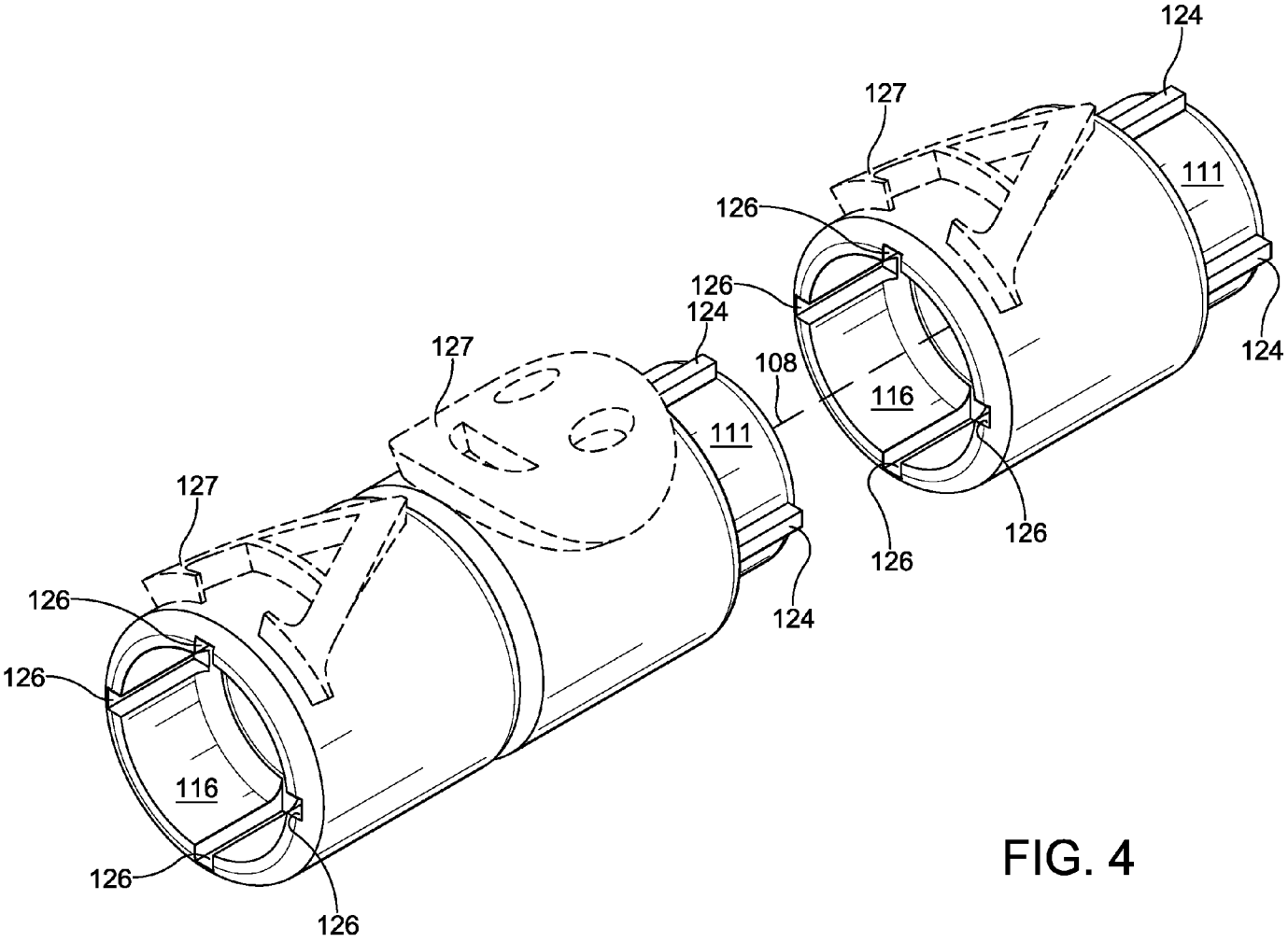
FIG. 4 illustrates the relationship between coupling mechanisms of tubular bodies.

Tubular body 102 may include a coupling mechanism 122 that allows for interconnection with another tubular body 102. For example, tubular bodies 102 may interconnect in an end-to-end fashion, such that top band 103 of first tubular body 102*a* engages and connects with bottom band 113 of second tubular body 102*b*, as shown in FIG. 4. In this manner, top band 103 of first tubular body 102*a* may be inserted into chamber 118 of second tubular body 102*b*, such that both first tubular body 102*a* and second tubular body 102*b* share a common longitudinal axis 108. Complementary parts of coupling mechanism 122 may interconnect to provide resistance to and/or prevent rotation of first tubular body 102*a* around longitudinal axis 108 relative to and second tubular body 102*b*.

In general, coupling mechanism 122 may be comprised of two complementary parts: a first coupling component 123 and a complementary second coupling component 125. A first part of coupling mechanism 122 may be an integrated part of top band 103, and a second part of coupling mechanism 122 may be an integrated part of bottom band 113. Thus, complementary parts of coupling mechanism 122 integrated into different tubular bodies 102 may cooperate to connect those tubular bodies 102. Complementary components of a coupling mechanism 122 may be located on either end of tubular body 102, such that tubular bodies 102 may be stacked and interlocked with one another. For example, top band 103 may include first coupling component 123 that is designed to engage with and interconnect with second coupling component 125 that is located on bottom band 113. Additionally or alternatively, top band 103 may include second coupling component 125 and bottom band 113 may include first coupling component 123. In this manner, first coupling component 123 of second tubular body 102*b* may connect with second coupling component 125 of first tubular body 102*a*.

First coupling component 123 may include at least a portion of top band outer surface 111 having a top band outer radius 112. Further, first coupling component 123 may include one or more tabs 124 formed on the portion of top band outer surface 111. Tab 124 may be considered the "male" component of a complementary male-and-female coupler. Tab 124 may be characterized as a raised, elongated member formed on top band outer surface 111. For example, as shown in the figures, tab 124 may be a rectangular flange. For example, the figures show tabs 124 a raised surface forming a rectangular surface parallel to a portion of top band outer surface 111. In this example, the longitudinal axis of tab 124 may be parallel to longitudinal axis 108. However, the shape of tab 124 is not necessarily limited to a rectangular one. Further, tab 124 may be aligned in a different direction than as shown in the figures.

Second coupling component 125 may include at least a portion of bottom band inner surface 116 that makes up chamber 118. Chamber 118 may have a bottom band inner radius 119 (e.g., a chamber radius). Bottom band inner radius 119 may be equal to or larger than top band outer radius 112. Chamber 118 may be shaped to receive first coupling component 123. Thus, the shape of at least a portion of bottom band inner surface 116 of chamber 118 may be complementary to the shape of at least a portion of top band outer surface 111 of first coupling component 123.

For example, first coupling component 123 may include one or more complementary grooves 126 located on bottom band inner surface 116. Additionally or alternatively, one or more tabs 124 may be located on bottom band inner surface 116 and one or more complementary grooves 126 may be located on top band outer surface 111. Tabs 124 and grooves 126 located on first tubular body 102*a* may be collinear, or they may be offset.

Groove 126 may have a complementary shape to tab 124, so that tab 124 fits within groove 126 in a snug relationship, such as a tongue-and-groove relationship. For example, tab 124 may be shaped to engagably slide into groove 126 as first tubular body 102*a* is slid on second tubular body 102*b* along longitudinal axis 108, where groove 126 is part of one tubular body 102 and tab 124 is part of the other tubular body 102, as shown in FIG. 1.

While the figures illustrate tabs 124 as only being part of first coupling component 123 and grooves 126 as only being part of second coupling component 125, either coupling mechanism may include tabs 124 and grooves 126. That is, first coupling component 123 may include one or more tabs 124 and/or grooves 126, and second coupling component 125 may include one or more tabs 124 and/or grooves 126.

For example, writing instrument 101 may be inserted into a series of tubular bodies 102, such as by successively sliding tubular bodies 102 onto body 110 of writing instrument 101 and engaging coupling mechanisms 122 of tubular bodies 102 after such tubular bodies 102 are slid onto writing instrument 101, engaging coupling mechanisms 122 of tubular bodies 102 to form a pencil grip 100 then sliding pencil grip 100 over writing instrument 101 to surround the circumferential surface of body 110, or some combination thereof. In this manner tubular bodies 102 may be removably engaged, and coupling mechanism 122 may operate to provide resistance against rotation of tubular bodies 102 relative to one another along longitudinal axis 108.

Tubular body 102 may have one or more characters 127 integrally affixed to one or more outer surfaces, such as top band outer surface 111 or bottom band outer surface 120. For example, character 127 may include one or more letters, numerals, symbols, designs, patterns, or the like. For example, characters 127 on tubular bodies 102 of pencil grip 100 include the letter "A" and a smiley face. Characters 127 may be raised, as shown in the figures, or engraved, or a combination thereof. Additionally or alternatively, tubular bodies 102 and/or their characters 127 may vary in color, texture, material, or other design, such that multiple tubular bodies 102 may be used to decorate or identify writing instrument 101.

As examples only, the technology disclosed herein can include one or more of the following implementations, or "aspects":

1. A pencil grip comprising: a first tubular body comprising: a first top band comprising: a first top band inner surface defining a passageway along a longitudinal axis; a first top band outer surface that encompasses the first top band inner surface, the first top band outer surface having a first top band outer radius; and a first tab located on the first top band outer surface; and a first bottom band distal from and integrally affixed to the first top band, the first bottom band comprising: a first bottom band inner surface defining a first chamber along the longitudinal axis, the first chamber having a chamber radius that is greater than the first top band outer radius; and a first groove located on the first bottom band inner surface; and a second tubular body removably engaged with the first chamber of the first tubular body, the second tubular body comprising: a second top band comprising: a second top band inner surface defining a chamber along the longitudinal axis; a second top band outer surface that encompasses the second top band inner surface, the second top band outer surface having a second top band outer radius that is greater than or equal to the first top band outer radius; a second tab located on the second top band outer surface; and a second bottom band distal from and integrally affixed to the second top band, the second bottom band comprising: a second bottom band inner surface defining a second chamber aligned with the longitudinal axis; and a second groove located on the first bottom band inner surface, the second groove removably engaged with the first tab and cooperating with the first tab to prevent relative rotation of the first tubular body and the second tubular body with respect to the longitudinal axis.

2. A pencil grip comprising: a first tubular body comprising: a first top band comprising: a first top band inner surface defining a passageway along a longitudinal axis; a first top band outer surface that encompasses a portion of the first top band inner surface, the first top band outer surface having a first top band outer radius; and a first tab located on the first top band outer surface; and a first bottom band distal from and integrally affixed to the first top band, the first bottom band comprising: a first bottom band inner surface defining a first chamber along the longitudinal axis, the first chamber having a chamber radius that is greater than the first top band outer radius; and a first groove located on the first bottom band inner surface; and a second tubular body removably engaged with the first chamber of the first tubular body, the second tubular body comprising: a second top band comprising: a second top band inner surface defining a chamber along the longitudinal axis; a second top band outer surface that encompasses a portion of the second top band inner surface, the second top band outer surface having a second top band outer radius that is greater than or equal to the first top band outer radius; a second tab located on the second top band outer surface; and a second bottom band distal from and integrally affixed to the second top band, the second bottom band comprising: a second bottom band inner surface defining a second chamber aligned with the longitudinal axis; and a second groove located on the first bottom band inner surface, the second groove removably engaged with the first tab and cooperating with the first tab to prevent relative rotation of the first tubular body and the second tubular body with respect to the longitudinal axis.

3. A pencil grip comprising: a first tubular body comprising: a first top band comprising: a first top band inner surface defining a passageway along a longitudinal axis; a first top band outer surface integrally with the first top band inner surface, the first top band outer surface having a first top band outer radius; and a first tab located on the first top band outer surface; and a first bottom band distal from and integral with the first top band, the first bottom band comprising: a first bottom band inner surface defining a first chamber along the longitudinal axis, the first chamber having a chamber radius that is greater than the first top band outer radius; and a first groove located on the first bottom band inner surface; and a second tubular body removably engaged with the first chamber of the first tubular body, the second tubular body comprising: a second top band comprising: a second top band inner surface defining a chamber along the longitudinal axis; a second top band outer surface integral with the second top band inner surface, the second top band outer surface having a second top band outer radius that is greater than or equal to the first top band outer radius; a second tab located on the second top band outer surface; and a second bottom band distal from and integrally affixed to the second top band, the second bottom band comprising: a second bottom band inner surface defining a second chamber aligned with the longitudinal axis; and a second groove located on the first bottom band inner surface, the second groove removably engaged with the first tab and cooperating with the first tab to prevent relative rotation of the first tubular body and the second tubular body with respect to the longitudinal axis.

4. A pencil grip comprising: a first tubular body comprising: a first top band having a first top band inner surface and a first top band outer surface, wherein the first top band inner surface defines a passageway along a longitudinal axis and the first top band outer surface first top band outer surface has a first top band outer radius; and a first tab located on the first top band outer surface; and a first bottom band distal from and integrally affixed to the first top band, the first bottom band comprising: a first bottom band inner surface defining a first chamber along the longitudinal axis, the first chamber having a chamber radius that is greater than the first top band outer radius; and a first groove located on the first bottom band inner surface; and a second tubular body removably engaged with the first chamber of the first tubular body, the second tubular body comprising: a second top band having a second top band inner surface and a second top band outer surface, wherein the second top band inner surface defines a chamber along the longitudinal axis and the second top band outer surface has a second top band outer radius that is greater than or equal to the first top band outer radius; a second tab located on the second top band outer surface; and a second bottom band distal from and integrally affixed to the second top band, the second bottom band comprising: a second bottom band inner surface defining a second chamber aligned with the longitudinal axis; and a second groove located on the first bottom band inner surface, the second groove removably engaged with the first tab and cooperating with the first tab to prevent relative rotation of the first tubular body and the second tubular body with respect to the longitudinal axis.

5. A pencil grip comprising: a first tubular body comprising: a first top band comprising: a first top band inner surface defining a passageway along a longitudinal axis; a first top band outer surface facing away from the first top band inner surface, the first top band outer surface having a first top band outer radius; and a first tab located on the first top band outer surface; and a first bottom band distal from and integrally affixed to the first top band, the first bottom band comprising: a first bottom band inner surface defining a first chamber along the longitudinal axis, the first chamber having a chamber radius that is greater than the first top band outer radius; and a first groove located on the first bottom band inner surface; and a second tubular body removably engaged with the first chamber of the first tubular body, the second tubular body comprising: a second top band comprising: a second top band inner surface defining a chamber along the longitudinal axis; a second top band outer surface facing away from the second top band inner surface, the second top band outer surface having a second top band outer radius that is greater than or equal to the first top band outer radius; a second tab located on the second top band outer surface; and a second bottom band distal from and integrally affixed to the second top band, the second bottom band comprising: a second bottom band inner surface defining a second chamber aligned with the longitudinal axis; and a second groove located on the first bottom band inner surface, the second groove removably engaged with the first tab and cooperating with the first tab to prevent relative rotation of the first tubular body and the second tubular body with respect to the longitudinal axis.

6. A pencil grip comprising: a first tubular body comprising: a first top band comprising: a first top band inner surface defining a passageway along a longitudinal axis; a first top band outer surface that encompasses the first top band inner surface, the first top band outer surface having a first top band outer radius; and a first tab located on the first top band outer surface; and a first bottom band distal from and integrally formed with the first top band, the first bottom band comprising: a first bottom band inner surface defining a first chamber along the longitudinal axis, the first chamber having a chamber radius that is greater than the first top band outer radius; and a first groove disposed on the first bottom band inner surface; and a second tubular body removably engaged with the first chamber of the first tubular body, the second tubular body comprising: a second top band comprising: a second top band inner surface defining a chamber along the longitudinal axis; a second top band outer surface that encompasses the second top band inner surface, the second top band outer surface having a second top band outer radius that is greater than or equal to the first top band outer radius; a second tab disposed on the second top band outer surface; and a second bottom band distal from and integrally formed with the second top band, the second bottom band comprising: a second bottom band inner surface defining a second chamber aligned with the longitudinal axis; and a second groove disposed on the first bottom band inner surface, the second groove removably engaged with the first tab and cooperating with the first tab to prevent relative rotation of the first tubular body and the second tubular body with respect to the longitudinal axis.

7. A pencil grip comprising: a first tubular body comprising: a first top band comprising: a first top band inner surface defining a passageway along a longitudinal axis; a first top band outer surface that encompasses the first top band inner surface, the first top band outer surface having a first top band outer radius; and a first tab located on the first top band outer surface; and a first bottom band distal from and integrally connected to the first top band, the first bottom band comprising: a first bottom band inner surface defining a first chamber along the longitudinal axis, the first chamber having a chamber radius that is greater than the first top band outer radius; and a first groove located on the first bottom band inner surface; and a second tubular body removably engaged with the first chamber of the first tubular body, the second tubular body comprising: a second top band comprising: a second top band inner surface defining a chamber along the longitudinal axis; a second top band outer surface that encompasses the second top band inner surface, the second top band outer surface having a second top band outer radius that is greater than or equal to the first top band outer radius; a second tab located on the second top band outer surface; and a second bottom band distal from and integrally connected to the second top band, the second bottom band comprising: a second bottom band inner surface defining a second chamber aligned with the longitudinal axis; and a second groove located on the first bottom band inner surface, the second groove removably engaged with the first tab and cooperating with the first tab to prevent relative rotation of the first tubular body and the second tubular body with respect to the longitudinal axis.

8. The pencil grip of aspect 1, 2, 3, 4, 5, 6, or 7, wherein the first tab comprises a plurality of tabs.

9. The pencil grip of aspect 1, 2, 3, 4, 5, 6, 7, or 8, wherein the passageway is adapted to receive a writing instrument.

10. The pencil grip of aspect 1, 2, 3, 4, 5, 6, 7, 8, or 9 wherein the first bottom band further comprises: a first bottom band outer surface that encompasses to the first bottom band inner surface; and a first character integrally affixed to the first bottom band outer surface.

11. The pencil grip of aspect 1, 2, 3, 4, 5, 6, 7, 8, 9, or 10, wherein the second bottom band further comprises: a second bottom band outer surface that encompasses to the second bottom band inner surface; and a second character integrally affixed to the second bottom band outer surface, wherein the first character is aligned with the second character.

12. The pencil grip of aspect 1, 2, 3, 4, 5, 6, 7, 8, 9, 10, or 11, wherein the first character comprises a raised symbol.

13. The pencil grip of aspect 1, 2, 3, 4, 5, 6, 7, 8, 9, 10, 11, or 12, wherein the second top band outer surface is concentric with the second top band inner surface.

14. The pencil grip of aspect 1, 2, 3, 4, 5, 6, 7, 8, 9, 10, 11, 12, or 13, wherein the passageway and the chamber are aligned to create a continuous aperture adapted to receive a writing instrument body.

15. The pencil grip of aspect 1, 2, 3, 4, 5, 6, 7, 8, 9, 10, 11, 12, 13, or 14, wherein the first tubular body further comprises a middle band axially disposed between the first top band portion and the first bottom top band portion, the middle band portion having a middle band outer radius that is greater than the top band outer radius, the middle band portion having a middle band inner surface defining a middle passageway, wherein a middle band inner radius is approximately equal to a first passageway radius of the passageway.

16. An apparatus comprising: a first band portion of a first band portion length, the first band portion comprising: a first inner surface defining a passageway along a longitudinal axis; and a first outer surface that encompasses the first inner surface, the first outer surface having a first outer radius; a second band portion integrally affixed to a first end of the first band portion, the second band portion comprising a second inner surface defining a chamber along the longitudinal axis, the chamber having an inner radius that is greater than the first outer radius; and a coupling mechanism comprising: at least one groove located at a first position on the second inner surface; and at least one tab located at a second position on the first outer surface, wherein the first position and the second position are collinear.

17. The apparatus of aspect 16, wherein the at least one groove is adapted to receive a second tab of a second apparatus.

18. The apparatus of aspect 16, wherein the at least one tab is adapted engage with a second groove of a second apparatus.

19. The apparatus of aspect 16, wherein the coupling mechanism is adapted to prevent relative rotation of the apparatus and a second apparatus coupled to the apparatus via the coupling mechanism.

20. The apparatus of aspect 16, wherein the passageway is adapted to receive a writing instrument.

21. The apparatus of aspect 16, further comprising a character integrally affixed to the outer surface.

22. The apparatus of aspect 16, wherein the at least one groove comprises a plurality of grooves and the at least one tab comprises a plurality of tabs.

23. The apparatus of aspect 22, wherein a number of the plurality of grooves is three and a number of the plurality of tabs is three.

24. A writing instrument comprising: a cylindrical body having a first end and a second end aligned along a longitudinal axis; a writing tip at a second end of the cylindrical body; and a removable attachment having a longitudinal passageway that receives and surrounds a portion of the cylindrical body, the removable attachment comprising: a first band portion comprising: a first inner surface defining the longitudinal passageway along the longitudinal axis; and a first outer surface that encompasses the first inner surface, the first outer surface having a first outer radius; a second band portion integrally affixed to a first end of the first band portion, the second band portion comprising a second inner surface defining a chamber along the longitudinal axis, the chamber having an inner radius that is greater than or equal to the first outer radius; and a coupling mechanism comprising: at least one groove located at a first position on the second inner surface; and at least one tab located at a second position on the first outer surface.

25. The writing instrument of aspect 24, wherein the first position and the second position are collinear.

26. The writing instrument of aspect 18, further comprising: a character integrally affixed to the outer surface.

While writing instrument attachments have been described in connection with the various embodiments of the various figures, it is to be understood that other similar embodiments can be used or modifications and additions can be made to the described embodiments for implementing writing instrument attachments without deviating therefrom. For example, one skilled in the art will recognize that writing instrument attachments as described in the present application may be designed with differing dimensions, and with differing characters 127. Therefore, writing instrument attachments should not be limited to any single embodiment, but rather should be construed in breadth and scope in accordance with the this description and the appended claims.

The invention claimed is:

1. A writing instrument comprising:
- a cylindrical body having a first end and a second end aligned along a longitudinal axis;
- a writing tip at a second end of the cylindrical body; and
- a removable attachment having a longitudinal passageway that receives and surrounds a portion of the cylindrical body, the removable attachment comprising:
  - a first band portion comprising:
    - a first inner surface defining a radius of the longitudinal passageway along the longitudinal axis; and
    - a first outer surface that encompasses the first inner surface, the first outer surface having a first outer radius;
  - a second band portion integrally affixed to a first end of the first band portion, the second band portion comprising a second inner surface defining a chamber along the longitudinal axis, the chamber having an inner radius that is greater than or equal to the first outer radius; and
  - a middle band axially disposed between the first top band portion and the first band portion, the middle band comprising a middle band inner surface having a middle band inner radius that is equal to the longitudinal passageway radius and a middle band outer surface that is greater than the first outer radius, the middle band inner surface further defining the passageway, and
- a coupling mechanism comprising:
  - at least one groove located at a first position on the second inner surface; and
  - at least one tab located at a second position on the first outer surface.

2. The writing instrument of claim 1, wherein the first position and the second position are collinear.

3. The writing instrument of claim 1, further comprising: a character integrally affixed to the outer surface.

4. A pencil grip comprising:
- a first tubular body comprising:
  - a first top band comprising:
    - a first top band inner surface defining a longitudinal passageway along a longitudinal axis, wherein the longitudinal passageway has a radius;
    - a first top band outer surface that encompasses the first top band inner surface, the first top band outer surface having a first top band outer radius; and
    - a first tab located on the first top band outer surface;
  - a first bottom band distal from and integrally affixed to the first top band, the first bottom band comprising:
    - a first bottom band inner surface defining a first chamber along the longitudinal axis, the first chamber having a chamber radius that is greater than the first top band outer radius; and
    - a first groove located on the first bottom band inner surface; and
  - a first middle band axially disposed between the first top band portion and the first bottom band portion, the first middle band comprising a middle band inner surface having a middle band inner radius that is equal to the longitudinal passageway radius and a middle band outer surface having a middle band outer radius that is greater than the first top band outer radius, the middle band inner surface defining a middle passageway; and a second tubular body removably engaged with the first chamber of the first tubular body,
- the second tubular body comprising:
  - a second top band comprising:
    - a second top band inner surface defining a chamber along the longitudinal axis; and
    - a second tab located on the second top band outer surface; and
  - a second bottom band distal from and integrally affixed to the second top band, the second bottom band comprising:
    - a second bottom band inner surface defining a second chamber aligned with the longitudinal axis; and
  - a second groove located on the first bottom band inner surface, the second groove removably engaged with the first tab and cooperating the first tab to prevent relative rotation of the first tubular body and the second tubular body with respect to the longitudinal axis.

5. The pencil grip of claim 4, wherein the first tab comprises a plurality of tabs.

6. The pencil grip of claim 4, wherein the passageway is adapted to receive a writing instrument.

7. The pencil grip of claim 4, wherein the first bottom band further comprises:
- a first bottom band outer surface that encompasses to the first bottom band inner surface; and a first character integrally affixed to the first bottom band outer surface.

8. The pencil grip of claim 4, wherein the second bottom band further comprises:

a second bottom band outer surface that encompasses to the second bottom band inner surface; and a second character integrally affixed to the second bottom band outer surface.

9. The pencil grip of claim 4, wherein the first character comprises a raised symbol.

10. The pencil grip of claim 4, wherein the second top band outer surface is concentric with the second top band inner surface.

11. The pencil grip of claim 4, wherein the first chamber and the passageway are aligned to create a continuous aperture adapted to receive a writing instrument body.

* * * * *